US006715501B2

(12) United States Patent
Pociask

(10) Patent No.: US 6,715,501 B2
(45) Date of Patent: Apr. 6, 2004

(54) FILTER CLEANING DEVICE AND SYSTEM

(76) Inventor: Stephen P. Pociask, 9326 Bay Vista Estates Blvd., Orlando, FL (US) 32836

( * ) Notice: Subject to any disclaimer, the term of this patent is extended or adjusted under 35 U.S.C. 154(b) by 0 days.

(21) Appl. No.: 09/862,263

(22) Filed: May 21, 2001

(65) Prior Publication Data

US 2002/0011259 A1 Jan. 31, 2002

Related U.S. Application Data

(60) Provisional application No. 60/206,103, filed on May 20, 2000.

(51) Int. Cl.[7] ..... B08B 3/02

(52) U.S. Cl. ..... 134/138; 134/152; 134/153; 134/157; 134/900

(58) Field of Search ..... 134/138, 137, 134/140, 141, 152, 153, 157, 900

(56) References Cited

U.S. PATENT DOCUMENTS 2,985,178 A * 5/1961 Christensen, Jr.
3,730,195 A * 5/1973 Kay
3,731,697 A * 5/1973 Yost
4,108,189 A * 8/1978 Claiborne et al.
4,417,496 A * 11/1983 Pahalen
4,606,777 A * 8/1986 Brow
4,672,987 A * 6/1987 Brandt
4,709,717 A * 12/1987 Rannigan et al.
4,723,564 A * 2/1988 West et al.
4,836,702 A * 6/1989 Allen
5,263,503 A * 11/1993 St. Jean
5,292,074 A * 3/1994 Clark et al.
5,409,027 A * 4/1995 Glunt
5,932,028 A * 8/1999 Carrie et al.
6,152,155 A * 11/2000 Milligan

* cited by examiner

*Primary Examiner*—Frankie L. Stinson
(74) *Attorney, Agent, or Firm*—Timothy H. Van Dyke; Beusse Brownlee Wolter Mora & Maire

(57) ABSTRACT

Disclosed herein are novel devices and methods for cleaning filters, preferably pool filters. The subject device and methods provide the advantages of cleaning the entire circumference of a cylindrical pool filter while minimizing the spray of water and debris onto the operator.

2 Claims, 5 Drawing Sheets

FILTER CLEANING DEVICE AND SYSTEM

CROSS REFERENCE TO RELATED APPLICATIONS:

This application is a non-provisional regular filing based on provisional application serial No. 60/206,103, filed May 20, 2000, from which the benefit is claimed under 35 U.S.C. § 119(e).

BACKGROUND OF THE INVENTION

In recent years, there has been a surge in the use of pool filtration systems that implement removable and replaceable filter cartridges. It is understood that to ensure that a pool filtration system operates at optimal efficiency and capacity, these filters must be cleaned regularly, up to 3 to 4 times a month. Cleaning pool filter cartridges can be a messy, inconvenient process, which more often than not causes splashing of debris and water from the filter onto the person cleaning the filter cartridge. Typically, filter cartridges are cleaned by spraying with a common garden hose. A portion of the filter is sprayed, and when that portion is satisfactorily cleaned, the filter must be handled, turned, and then sprayed again at another portion of the filter. This process requires the person cleaning the filter to handle and spray the filter in this manner several times to accomplish one cleaning. The more handling and spraying of the filter, the more time cleaning is expended, and the degree of mess is increased as well. Also, the conventional cleaning process causes much of the debris to be thrown onto other portions of the filter that have already been sprayed, which results in undesired repeat cleaning of areas already sprayed. Surprisingly, despite these common and prevalent problems, there are very few devices that have been developed to wash pool filter cartridges.

U.S. Pat. No. 5,292,074, represents an attempt to address the foregoing problems associated with cleaning pool filters. The device disclosed in the '074 patent pertains to a spray nozzle device that comprises a concave manifold having a series of spray jets to concentrate spraying of the filter. While the '074 device tries to cover more surface area of the filter, the user must still handle and turn the filter and repeatedly spray multiple portions of the filter. Moreover, the problem of debris being thrown to portions that have already been sprayed is not addressed by the '074 device.

Accordingly, a need remains in the art for a system to clean pool filter cartridges and other objects that is quick and simple to use, and which minimizes the mess commonly associated with such cleaning.

SUMMARY OF THE INVENTION

The subject invention pertains to a device, and method for using same, designed to quickly and efficiently clean a pool filter cartridge. The subject cleaning device comprises a conduit having a plurality of openings through which a fluid passes, the conduit being of such a configuration as to allow more than half of the circumference (i.e., more than 180 degrees) of the filter cartridge to be sprayed simultaneously. Preferably, the conduit is of such a configuration as to allow the filter to be sprayed up to its entire circumference (about 360 degrees) simultaneously. Even more preferably, the subject cleaning device comprises a conduit having a circular portion, the circular portion being of a sufficient diameter to completely allow the filter cartridge to pass through the circular portion. The conduit is connected to a fluid source either directly at a location along the circular portion, or alternatively, the conduit has a handle portion that extends from the circular portion to which a fluid source can be connected.

A further aspect of the subject invention pertains to a method of cleaning an object comprising spraying the object with a cleaning device, wherein the cleaning device comprises a conduit having a plurality of openings and which is configured such that more than half of the circumference of the object is sprayed simultaneously.

Yet another aspect of the subject pertains to a cleaning device as described above further equipped with a shield attached thereto. The shield is preferably positioned on the cleaning device such that the splashing of fluid and debris back onto the user is decreased. In most instances, the shield is positioned between the user and the cleaning device.

Further still, another aspect of the subject invention pertains to a rotating stand onto which a filter cartridge can be securely fastened. When using the rotating stand, the adjustable jets of the cleaning device as described above are all pointed in a similar direction, preferably at a right or left oblique direction. As the subject cleaning device is brought into proximity with the filter cartridge, or passed over it, the filter cartridge begins to spin in the direction the adjustable jets are pointing. This technique further facilitates the cleaning process and is a significant improvement over conventional techniques.

These and other advantageous aspects of the subject invention will be further described below.

DESCRIPTION OF THE DRAWINGS

FIGS. 1B and 1C show various removable attachments and inserts for use with subject cleaning device, as described below.

FIG. 3C shows a cross section of assembled portions shown in FIGS. 3A–B.

DESCRIPTION OF THE PREFERRED EMBODIMENTS

Figures 1A, 1B, 1C:
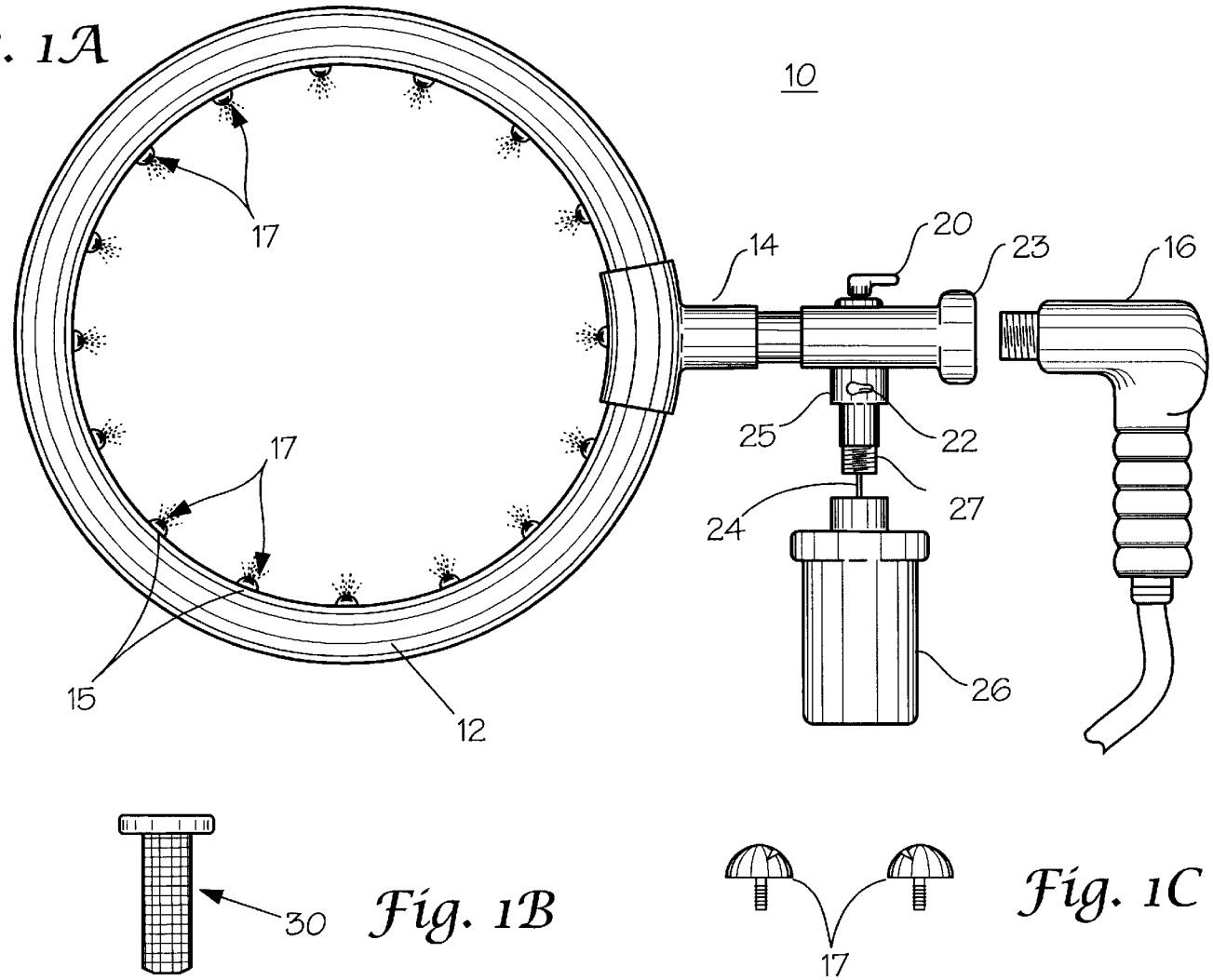
FIGS. 1A–C show a side view of a first embodiment of the subject invention that comprises several novel features to accomplish greater cleaning efficiency.

Turning to FIG. 1, a first embodiment 10 of the subject cleaning device is shown that is especially designed for simultaneous cleaning of an object at and angle of more than 180 degrees (i.e., more than half the circumference of a planar cross-section). Specifically exemplified in FIG. 1 is a cleaning device that sprays at an angle of 360 degrees (i.e., the entire circumference of a planar cross-section). Cleaning device 10 comprises a circular portion 12 that has a series of openings 15 spaced along the interior surface of the circular portion 12. Preferably, the openings 15 have secured therein rotatable spray jets 17 (FIG. 1C). The direction of the spray jets 17 can be adjusted by simply turning them. The circular portion is preferably of a diameter sufficient to pass over the object intending to be cleaned, i.e., the object can pass through the circular portion 12. While pool filter cartridges are the preferred object to be cleaned, those skilled in the art will readily appreciate other objects for cleaning by the subject cleaning device as well, including, but not limited to, dirty paint rollers, shovels and other tools, or statues and other outdoor ornaments. Cleaning device 10 comprises a handle portion 14 that is rigidly engaged to the circular portion 12. The handle portion 14 can vary in length depending on the intended use. Preferably, the handle portion 14 is between about 3 inches to about 36 inches in length. The handle portion may be even longer in length if a long reach is needed such as for large industrial filter cartridges. Alternatively, the handle portion 14 may be configured to removably attach to conventional extendible pool poles known in the pool industry. Handle portion 14 has an open end 23 that is preferably threaded to attach to a fluid supply 16. The fluid supply is preferably a water supply, but it can be other types of fluids, such as organic solvents for greasy tools and/or auto parts. Typically, the cleaning device 10 is attached to a common garden hose that is attached to a water faucet. In another preferred embodiment the handle portion can be equipped with a siphoning adapter 25. The siphoning adapter allows for an enhancement in the cleaning power of the subject cleaning device 10, as it incorporates soaps and other cleansers in the fluid that is propelled out of the openings 15. The siphoning adapter 25 preferably has a siphoning valve 22, a siphon line 24 and a cleaning solution container 26, that attaches to the siphon adapter, preferably by threads 27, formed on said siphoning adapter. As mentioned above, the cleaning solution disposed in said cleaning solution container 26 can be one of or a combination of commercial available soaps, conditioners, detergents and other cleansers, as well as algaecides, antibacterial agents and other antimicrobial agents. The handle portion 14 can also comprise a fluid on/off valve 20 for controlling the rate of fluid flow through the cleaning device 10. Preferably, a screen 30 (FIG. 1B) is positioned within the open end 23 to prevent dirt and other debris from entering and clogging the cleaning device 10.

Figure 2:
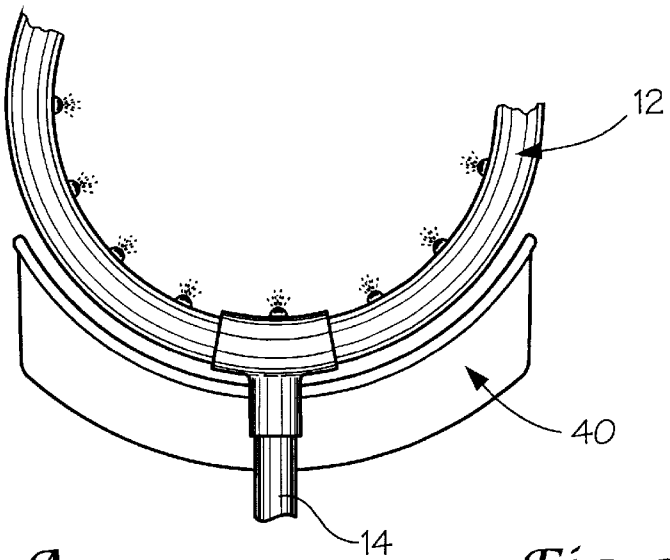
FIG. 2 shows a sectional view of the embodiment shown in FIG. 1, which comprises a means to protect the user from splashing water and other debris.

FIG. 2 shows a sectional view of the cleaning device 10 that is further equipped with a splash shield 40. As shown, the splash shield 40 covers the side of the circular portion 12 to which the handle portion 14 is attached. This positioning of the shield optimizes the protection for the user. Naturally, the splash shield 40 can extend up to entire circumference of the circular portion 12 if desired, or can be positioned anywhere along the circular portion.

Figure 3B:
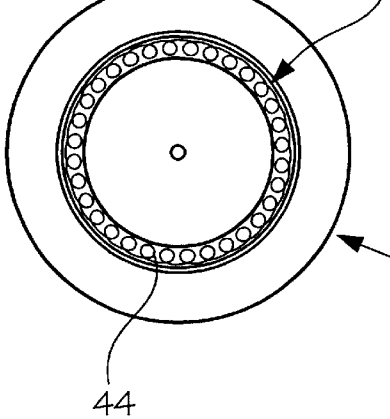
FIGS. 3A–C show a second embodiment of the subject invention, depicting a first portion, FIG. 3A, and a second portion, FIG. 3B, which fasten together.
Figure 3C:
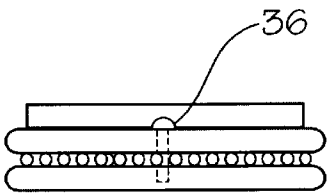
Figure 3A:
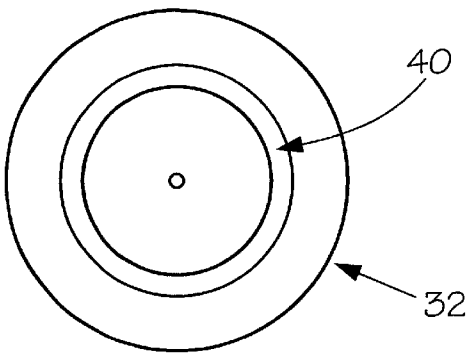
Figure 4:
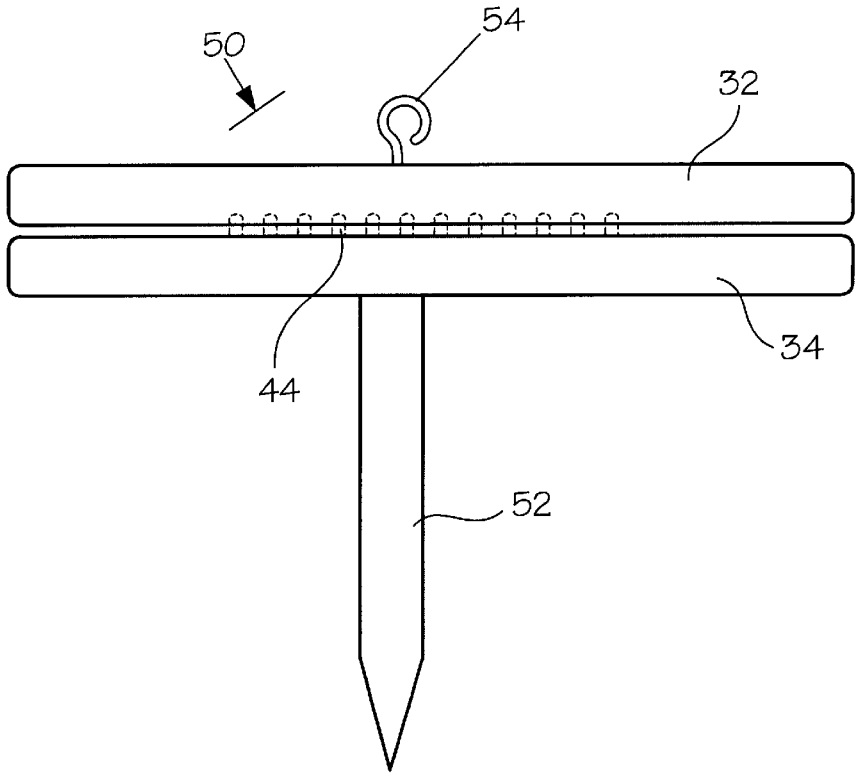
FIG. 4 shows a side elevational view of third embodiment of the subject invention that relates to a rotating stand that can be stabilized through implantation into the ground.
Figure 6:
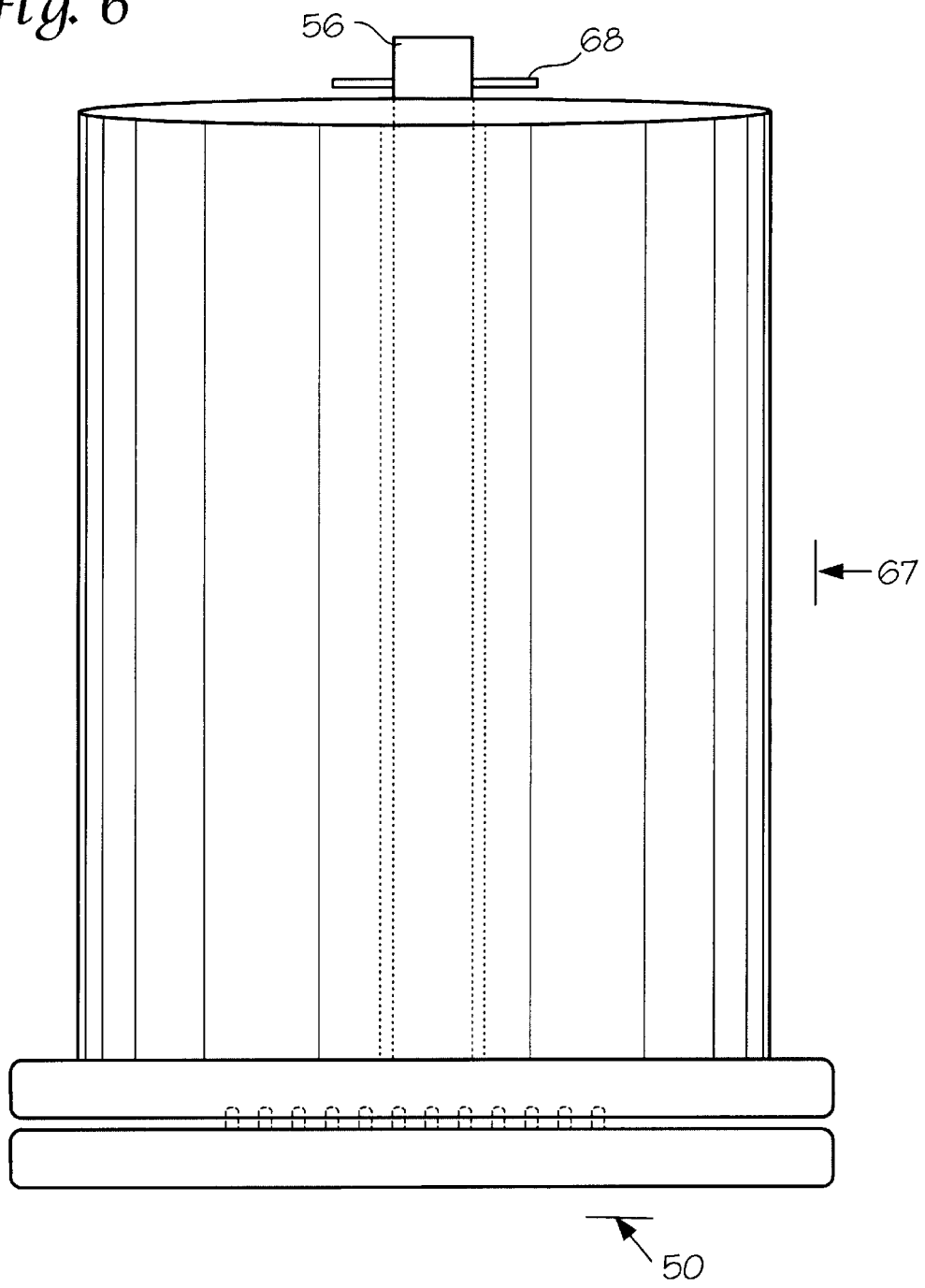
FIG. 6 shows a use of the embodiment of FIG. 4.

In FIGS. 3 and 4, a further embodiment of the subject invention is shown that is directed to a rotating stand 50, onto which an object to be cleaned is fastened. Preferably, the object is a pool filter cartridge that is set on top of the stand 50, and securely fastened thereon (as shown in FIG. 6). Once fastened, the subject cleaning device 10 is passed over the pool filter to remove dirt and other debris. Preferably, the spray jets 17 of the cleaning device are pointed in the same direction, typically right or left, and as the cleaning device 10 is brought in proximity with the pool filter cartridge, it begins to rapidly rotate in the direction of the spray jets 17. The centrifugal force of the rotating pool filter acts to push off debris on the pool filter. Accordingly, the rotating stand 50 and cleaning device 10 provide a system whereby the spray force of the spray jets 17 is coupled with centrifugal force of the rotating pool filter to achieve a synergistic cleaning effect.

FIG. 3 shows one embodiment of the rotating stand 50 that comprises a first plate 32 (FIG. 3A) and a second plate 34 (FIG. 3B) that are attached by attachment means 36 (FIG. 3C) such as a nut and bolt, clips, screws, etc. To aid in the rotating action of the rotating stand 50, grooves 40 and 42 are inscribed on the plates 32 and 34, and ball bearings 44 are disposed in said grooves. FIG. 3C shows a cross section of the assembled rotating stand 50, which reveals the ball bearings 44 and fastening plate attachment means 36.

Figure 5:
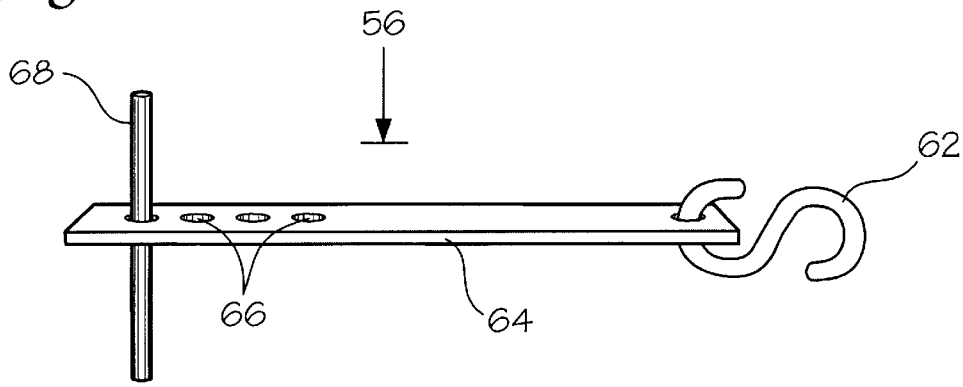
FIG. 5 shows a fourth embodiment of the invention.

FIG. 4 shows a preferred version of the rotating stand 50 that is equipped with a stabilizing spike 52 that is attached to the bottom of the rotating stand 50. The stabilizing spike 52 is preferably driven into the ground to aid in keeping the rotating stand 50 from sliding or tilting on the ground. The rotating stand 50 can be driven into the ground conveniently near the pool filtering system. An object fastener attachment 54 is engaged to the top of the rotating stand 50, which preferably engages an object fastener 56 (shown in FIG. 5). The object fastener 56 comprises a body portion 64 that is preferably made of an elastic material, such as, e.g., rubber, plastic, bungeecord, etc. The body portion preferably has a series of holes 66 formed thereon, into which a securing rod 68 is inserted. At an end opposite the securing rod 68, a hook means is engaged to the object fastener 56 which is of a size and shape to engage the object fastener attachment 54. The object fastener 56 is engaged to the object fastener attachment 54 and then stretched through the object, whereby the securing rod 68 is inserted through a hole 66. The elastic action of the body portion 64 pulls the securing rod 68 down onto the object, thereby holding the object in place. FIG. 6 shows a pool filter cartridge 67 fastened into place.

In an alternative embodiment, the object fastener can comprise a post secured to the top of the rotating stand onto which an object such as a pool filter cartridge can slide over and be fastened into place. Those skilled in the art will readily appreciate other systems to fasten objects onto the rotating stand, when considered in view of the teachings herein.

Figure 7:
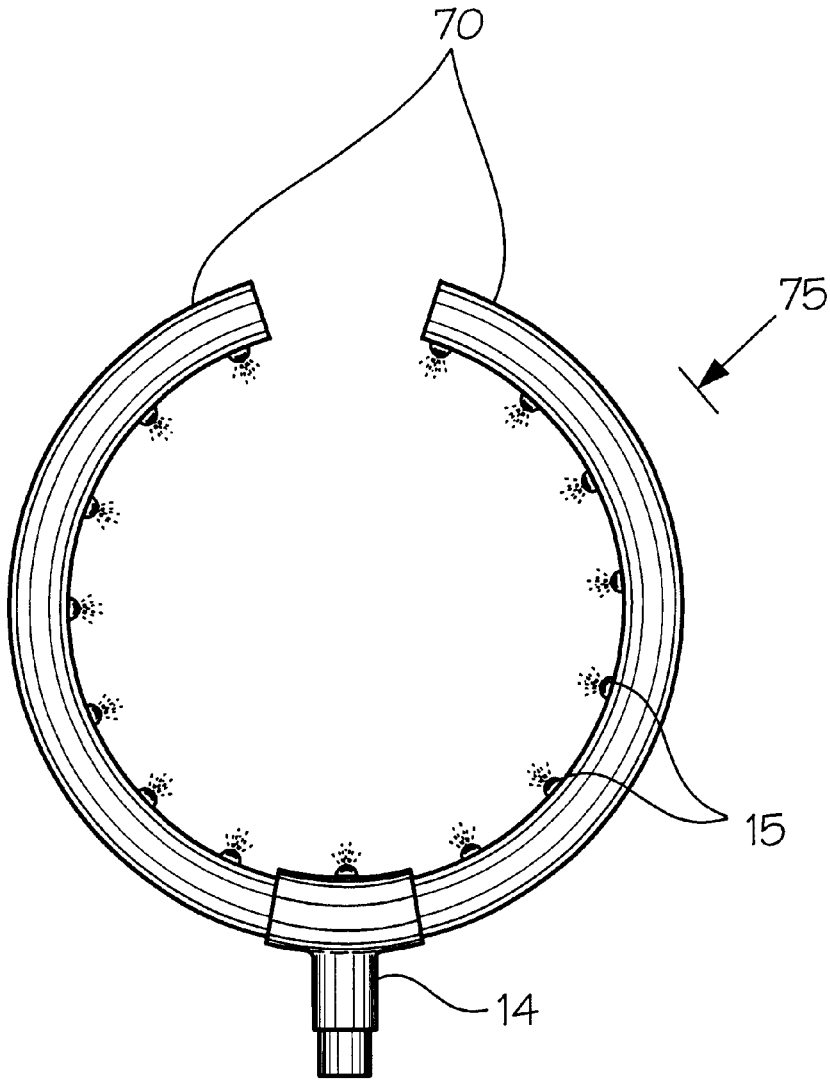
FIG. 7 shows a side view of another embodiment of the subject invention. The embodiment shown represents a variation of the broad concept of simultaneous spraying of an object at more than 180 degrees.

In another alternative embodiment shown in FIG. 7, the subject cleaning device comprises a conduit comprising a substantially circular portion 70, that has a plurality of openings 15 positioned along its interior surface. When a fluid supply is connected to the handle portion 14, fluid sprays out of the openings 15, and, similar to embodiment 10, the cleaning of an object at more than 180 degrees is enabled.

The teachings of all references cited throughout this specification are incorporated in their entirety to the extent that they are not inconsistent with the teachings herein. It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. An object cleaning system comprising a device for cleaning an object comprising a fluid conduit that comprises a plurality of openings, wherein said fluid conduit comprises an aperture for connecting a fluid supply and wherein said plurality of openings are positioned on said fluid conduit as to allow the simultaneous spraying of said object at between about 270 and about 360 degrees, and wherein said device comprises a splash shield attached to or integral with said fluid conduit; a rotating stand comprising a top portion and a bottom portion engaged together such that the top portion can freely rotate in relation to the bottom portion, and a fastener means for securely fastening an object to said top portion;

wherein said object is a pool filter cartridge comprising a central channel;

wherein said fastener means passes through said central channel; and wherein said rotating stand further comprises a stabilizer rigidly engaged to said bottom portion.

2. The rotating stand of claim 1 wherein said stabilizer is a spike that is capable of being driven into the ground.

* * * * *